United States Patent [19]

Toyama

[11] Patent Number: 4,572,151

[45] Date of Patent: Feb. 25, 1986

[54] IGNITION SYSTEM FOR INTERNAL COMBUSTION ENGINES

[75] Inventor: Koichi Toyama, Kariya, Japan

[73] Assignee: Nippondenso Co., Ltd., Kariya, Japan

[21] Appl. No.: 635,180

[22] Filed: Jul. 27, 1984

[30] Foreign Application Priority Data

Aug. 4, 1983 [JP] Japan ..... 58-143345
Oct. 14, 1983 [JP] Japan ..... 58-193243

[51] Int. Cl.[4] ..... F02P 15/08

[52] U.S. Cl. ..... 123/622; 123/643; 123/618

[58] Field of Search ..... 123/621, 622, 618, 643, 123/651, 609

[56] References Cited

U.S. PATENT DOCUMENTS

| | | | |
|---|---|---|---|
| 3,943,896 | 3/1976 | Green et al. | 123/618 |
| 4,357,927 | 11/1982 | Igashira et al. . | |
| 4,361,129 | 11/1982 | Sugie et al. | 123/622 |
| 4,378,004 | 3/1983 | Petrie | 123/643 |
| 4,380,980 | 4/1983 | Javeri | 123/643 |
| 4,385,605 | 5/1983 | Petrie et al. | 123/643 |

FOREIGN PATENT DOCUMENTS 55-37536 3/1980 Japan .

*Primary Examiner*—Parshotam S. Lall
*Attorney, Agent, or Firm*—Cushman, Darby & Cushman

[57] ABSTRACT

An ignition system for an internal combustion engine includes an ignition coil having a plurality of primary coils corresponding respectively to individual cylinders of the internal combustion engine, a basic ignition signal detector for producing basic ignition signals in synchronism with the engine rotation, an ignition control circuit for receiving the basic ignition signals and producing an ignition control signal having a controlled predetermined pulse width, a basic cylinder discriminating signal detector for producing a basic cylinder discriminating signal having a period twice that of the basic ignition signals in synchronism with the engine rotation, a cylinder discriminating signal forming logic circuit for receiving the ignition control signal and the basic cylinder discriminating signal and forming a cylinder discriminating signal by changing-over the basic cylinder discriminating signal in accordance with a state thereof, at a transition point of a waveform of the ignition control signal which corresponds to an ignition time of the engine, and an energization signal forming logic circuit for generating an energization signal which controls the energization of a primary coil of the ignition coil for an engine cylinder corresponding to a logic operation output obtained by performing a logic operation on the cylinder discriminating signal and the ignition control signal. This ignition system extends the controllable range of the ignition signal and improves the operational performance of the engine.

7 Claims, 5 Drawing Figures

IGNITION SYSTEM FOR INTERNAL COMBUSTION ENGINES

The present invention relates to an ignition system for internal combustion engines, and in particular to an improved ignition system for an internal combustion engine having an extended controllable range of an ignition signal. The ignition system for an internal combustion engine according to the present invention may be satisfactorily applied to a distributorless ignition system having a plurality of ignition coils corresponding to the number of cylinders of the internal combustion engine, or to an ignition system with a distributor having two high voltage diodes incorporated in the electric circuit of the distributor rotor.

As a prior art system, there is an ignition system for an internal combustion engine such as disclosed in Japanese Patent Application Kokai (Laid-open) No. 55-37536 (1980), which includes an ignition signal generator for generating a plurality of ignition signals corresponding to the number of cylinders of the internal combustion engine by detecting the rotation of a rotor of the ignition signal generator, and a cylinder discriminating signal generator for generating a cylinder discriminating signal having a period twice that of the ignition signal by detecting the rotation of a rotor of the cylinder discriminating signal generator, whereby the plurality of ignition signals are distributed to the respective engine cylinders in accordance with the cylinder discriminating signal to interrupt a primary current flowing through the ignition coil for each engine cylinder. In such an ignition system, there is no problem insofar as the generation time of the ignition signal, which does not vary. However, there arises a problem if the ignition system is applied to an electronic control system which electronically controls the ignition time (the turn-off time of the primary current of the ignition coil) and the energization starting time of the ignition coil. That is, if the energization starting time of the ignition coil deviates from the corresponding discrimination phase of the cylinder discriminating signal due to the electronic control by the electronic control system, then the ignition coils for the cylinders other than the cylinder to be ignited are caused to operate incorrectly in accordance with the amount of such deviation, and at the same time the energization period of the ignition coil for the cylinder to be ignited is shortened, so that sufficient ignition energy may not be obtained.

Furthermore, an ignition device for a multicylinder internal combustion engine disclosed in U.S. Pat. No. 4,357,927 includes an ignition signal generator for generating a plurality of ignition signals corresponding to the number of cylinders of the internal combustion engine, a reference cylinder signal generator for generating a narrow reference pulse signal at a reference cylinder position, and a cylinder discriminating signal forming circuit which is reset by the reference pulse signal and is inverted at every rise in the waveform of the ignition signal at the energization starting time of the ignition coil to form a cylinder discriminating signal having a period twice that of the ignition signal, whereby the plurality of ignition signals are distributed to the respective engine cylinders in accordance with the cylinder discriminating signal to interrupt a primary current flowing through the ignition coil for each engine cylinder. However, also in this case, when the ignition device is applied to an electronic control system for electronically controlling the ignition time and the energization starting time of the ignition coil, and if the energization starting time of the ignition coil indicated by the ignition signal is advanced with respect to the reference pulse signal due to the electronic control by the electronic control system, the cylinder discriminating signal will have an inverse phase with respect to the cylinder to be ignited, thus giving rise to an erroneous signal and thereby making it impossible to perform a proper igniting operation.

As described above, the prior art ignition systems have a drawback such that, when the ignition time and the energization starting time of the ignition coil are controlled electronically, the width of the controllable range for both of the ignition time and the energization starting time is limited to a narrow range for preventing an erroneous operation. The present invention is intended to obviate such a drawback of the prior art ignition systems.

The object of the present invention is to provide an ignition system for an internal combustion engine in which the controllable range of an ignition signal is extended so as to improve the operating performance of the engine.

Another object of the present invention is to prevent erroneous ignition from being produced in any other cylinder and to make ignition occur only in a proper cylinder to be ignited at the start of the engine.

The present invention is featured by the construction of an ignition system for an internal combustion engine which includes an ignition coil having primary coils corresponding respectively to individual engine cylinders, a basic ignition signal detector for producing basic ignition signals, which correspond to the number of the engine cylinders, in synchronism with the engine rotation, an ignition control circuit for receiving the basic ignition signals and producing an ignition control signal having a controlled predetermined pulse width, a basic cylinder discriminating signal detector for producing a basic cylinder discriminating signal having a period twice that of the basic ignition signals in synchronism with the engine rotation, a cylinder discriminating signal forming logic circuit for receiving the ignition control signal and the basic cylinder discriminating signal and forming a cylinder discriminating signal by changing over the basic cylinder discriminating signal in accordance with a state thereof, at a transistion point of a waveform of the ignition control signal which corresponds to an ignition time of the engine, and an energization signal forming logic circuit for generating an energization signal which controls the energization of a primary coil for an engine cylinder corresponding to a logic operation output obtained by performing a logic operation on the cylinder discriminating signal and the ignition control signal, whereby a phase of the cylinder discriminating signal is varied in response to the transition of the ignition control signal having the controlled predetermined pulse width.

These and other objects, features and advantages of the present invention will be apparent from the following descriptions taken in conjunction with the accompanying drawings.

In the drawings, like reference numerals refer to like parts.

Figure 1:
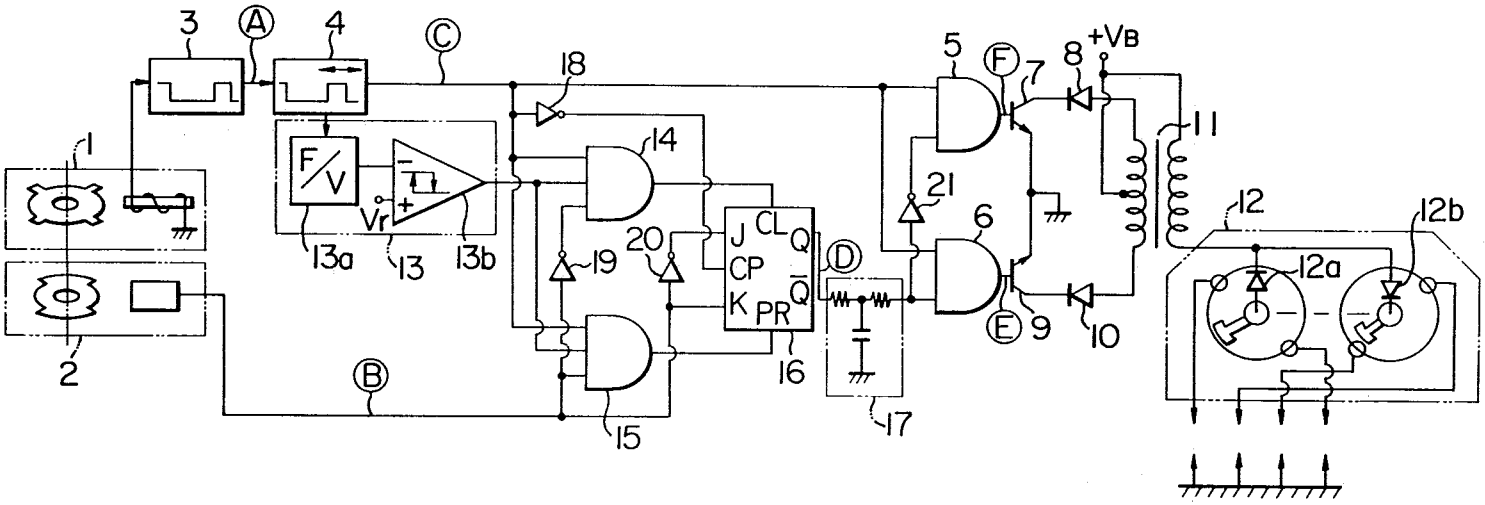
FIG. 1 is an electric circuit diagram illustrating an ignition system of an embodiment of the present invention.

Referring to FIG. 1, reference numeral 1 designates an electromagnetic pickup shown as an example of an ignition signal producing sensor. The electromagnetic pickup 1 produces, in synchronism with the rotation of the engine, an A.C. output signal of four cycles per engine rotation, for example, corresponding to the number of engine cylinders. Numeral 2 designates a position sensor operating as a cylinder discrimination sensor, which is formed by utilizing, for example, a Hall-effect element or the like and generates, in synchronism with the rotation of the engine, a rectangular wave output of two cycles per engine rotation and having a period twice that of the output signal of the electromagnetic pickup 1. Numeral 3 designates a waveform shaping circuit for shaping the output signal waveform of the electromagnetic pickup 1 to produce a basic ignition signal. Numeral 4 designates an ignition control circuit responsive to the basic ignition signal for generating an ignition control signal for electronically controlling the ignition time (the turn-off time of the primary current of the ignition coil) and the turn-on time of the primary current of the ignition coil. Numerals 5 and 6 designate AND circuits which respectively generate, in accordance with the cylinder discriminating signal, distribution signals for alternately operating transistors 7 and 9. Numerals 8 and 10 respectively designate reverse current blocking diodes. Numeral 11 designates an ignition coil having two primary windings. Numeral 12 designates an ignition distributor using two high voltage diodes 12*a* and 12*b* to perform two-sectioned distribution.

Numeral 13 designates an engine rotational speed detecting circuit comprised of an F/V converter 13*a* and a comparator 13*b* for producing an analog signal, whose magnitude depends on a frequency of the ignition control signal, for example, in other words, an engine rotational speed, and then generating a logic signal "0" at and higher than a predetermined engine rotational speed and a logic signal "1" at and lower than a predetermined engine rotational signal. Numerals 14 and 15 respectively designate AND circuits, and 16 designates a J-K masterslave flip-flop (hereinafter referred to as a J-K flip-flop). Numeral 17 designates a delay circuit, and 18–21 respectively designate NOT circuits.

Figure 2:
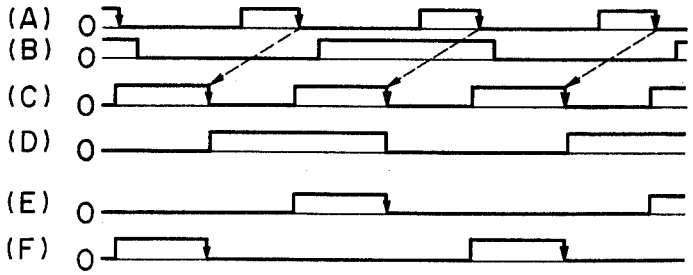
FIG. 2 is a waveform diagram showing the waveforms appearing at various portions of the ignition system shown in FIG. 1 useful for explaining the operation of the ignition system.

The operation of the ignition system described above will be explained with reference to the operation waveform diagram shown in FIG. 2. The A.C. signal produced by the pickup 1 is shaped in waveform through the waveform shaping circuit 3 to produce the basic ignition signal shown at (A) of FIG. 2. This basic ignition signal is supplied to the ignition control circuit 4. Then, the ignition control circuit 4 produces the ignition control signal shown at (C) of FIG. 2, which ignition control signal indicates the ignition time and the energization starting time of the ignition coil which are electronically controlled, respectively. In other words, in the waveform of the ignition control signal shown at (C) of FIG. 2, the rising edge thereof indicates the energization starting time of the ignition coil and the falling edge thereof the ignition time.

Firstly, when the engine rotational speed is higher than a preset rotational speed of the engine rotational speed detecting circuit 13, the output of the engine rotational speed detecting circuit 13 delivers a logic signal "0", so that the outputs of the respective AND circuits 14 and 15 become "0". As a result, the Q output signal of the J-K flip-flop 16 is inverted each time the waveform of an input signal to the clock pulse input (CP) rises, that is, each time the waveform shown at (C) of FIG. 2 falls, and the Q output signal having a waveform shown at (D) of FIG. 2 is obtained. Since the Q output signal of the J-K flip-flop 16 is applied to both of the AND circuits 5 and 6 after having been delayed to some degree through the delay circuit 17, the basic cylinder discriminating signal of the waveform shown at (B) of FIG. 2 is assuredly transformed into the cylinder discriminating signal of the waveform shown at (D) of FIG. 2, and it is possible to prevent the occurrence of an erroneous operation which arose in the prior art systems. Thus, an advance range of the ignition timing can be freely chosen so long as each respective trailing edge in the waveform of the ignition control signal shown at (C) of FIG. 2 occurs while the basic cylinder discriminating signal shown at (B) of FIG. 2 is supplied to the J and K inputs of the J-K flip-flop 16, respectively. Thus, it is possible to provide a wide range of spark advance. Then, the ignition control signal shown at (C) of FIG. 2 is separated and distributed as shown respectively at (E) and (F) of FIG. 2 by the selective gating operation of the AND circuits 5 and 6 which is caused by the application of the delayed cylinder discriminating signal. The resultant distributed ignition control signals shown at (E) and (F) of FIG. 2 operate to turn on and off the transistors 9 and 7, respectively.

Next, the operation of the engine rotational speed detecting circuit 13 and the AND circuits 14 and 15 will be described in more detail. At the start of the engine, before a fall occurs in the waveform of the ignition control signal shown at (C) of FIG. 2, which of the power transistors 7 and 9 firstly becomes conductive can not be decided. For this reason, at the start of the engine, there is a danger such that an erroneous ignition may be caused only once in the opposite side engine cylinder. In order to solve this problem, the ignition system of this invention is constructed so that, so far as it is detected by the engine rotational speed detecting circuit 13 that the engine rotational speed is low, the engine rotational speed detecting circuit outputs a logic signal "1" to apply it to both of the AND circuits 14 and 15, and the J-K flip-flop 16 operates to produce the cylinder discriminating signal, which is formed unconditionally to have the same waveform as that of the basic cylinder discriminating signal, in accordance with the phase relation between the basic cylinder discriminating signal, which and whose inversion signal are applied to the AND circuits 15 and 14, respectively, and the ignition control signal which is applied to both of the AND circuits 14 and 15, respectively, and by applying the output signal of the AND circuit 14 to the clear input (CL) and the output signal of the AND circuit 15 to the preset input (PR) to the J-K flip-flop 16, respectively.

Figure 4:
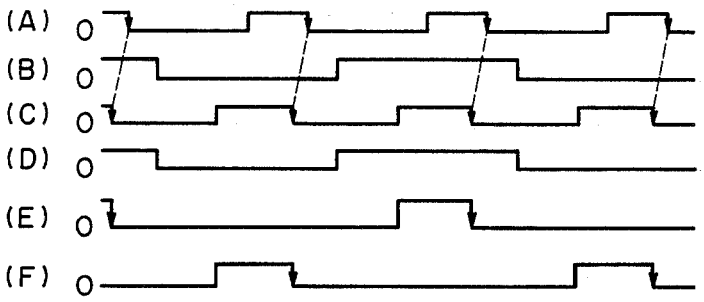
FIG. 4 is a waveform diagram showing the waveforms appearing at various portions of the ignition system shown in FIG. 3 useful for explaining the operation of the ignition system.

Next, another embodiment of the present invention will be described with reference to the electric circuit diagram shown in FIG. 3 and the operation waveform diagrams shown in FIGS. 2 and 4.

Figure 3:
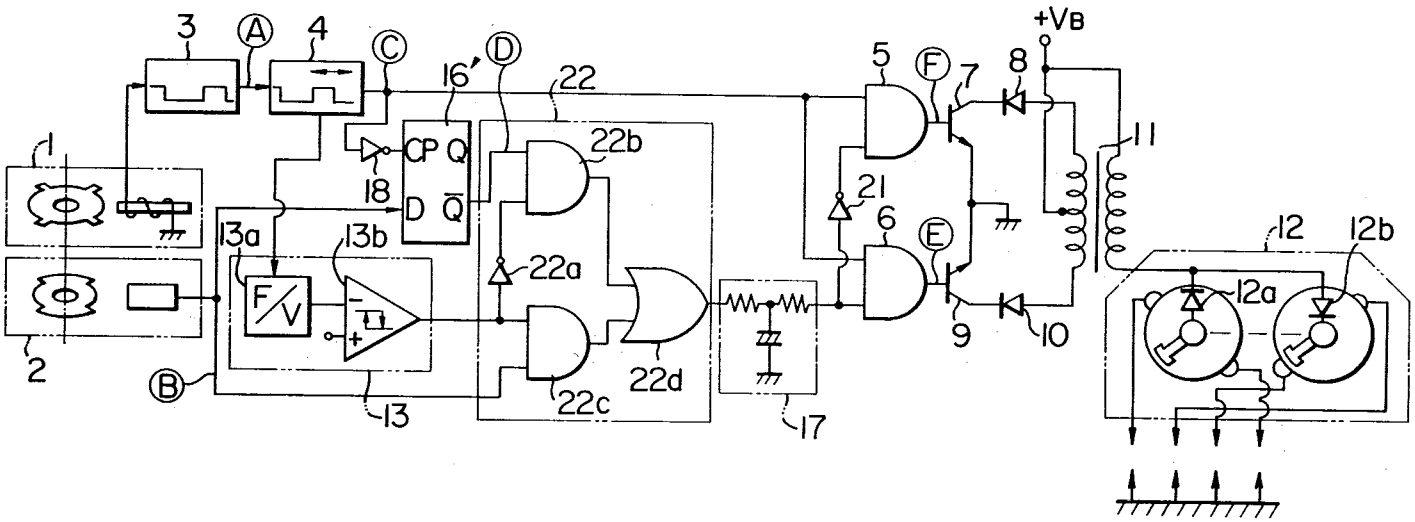
FIG. 3 is an electric circuit diagram illustrating an ignition system of another embodiment of the present invention.

In FIG. 3, numeral 16' designates a D-type flip-flop. Numeral 22 designates a cylinder discriminating signal change over circuit which is comprised of a NOT circuit 22*a*, AND circuits 22*b* and 22*c*, and an OR circuit 22*d*.

The operation of the ignition system of the another embodiment shown in FIG. 3 and having the construction such as described above will be explained hereunder.

Firstly, referring to FIG. 2, a description will be made of a case where the engine rotational speed is higher than the preset rotational speed of the engine rotational speed detecting circuit 13. In this case, since the output of the engine rotational speed detecting circuit 13 delivers a logic signal "0", the gate of the AND circuit 22*C* of the cylinder discriminating signal change over circuit 22 is closed, but, on the other hand, the gate of the AND circuit 22*b* is opened. Here, the $\overline{Q}$0 output of the D-type flip-flop 16' has a waveform such as shown at (D) of FIG. 2. More precisely, the cylinder discriminating signal of the waveform shown at (D) of FIG. 2 is obtained by inverting the basic cylinder discriminating signal of the waveform shown at (B) of FIG. 2, which is the output signal of the cylinder discrimination sensor 2, each time the ignition control signal of the waveform shown at (C) of FIG. 2, which is the output signal of the ignition control circuit 4, falls, in other words, the basic cylinder discriminating signal is inverted each time the clock pulse input signal (CP) to the D-type flip-flop 16' rises. Consequently, even if the ignition time is advanced by a great amount as shown at (C) of FIG. 2 relative to the output waveform of the waveform shaping circuits shown at (A) of FIG. 2, by virtue of the discriminating operation of a cylinder discriminating signal forming means constituted by the D-type flip-flop 16', the control of the energization of the ignition coil can be achieved without causing any erroneous operation as seen from each of the waveforms shown at (E) and (F) of FIG. 2.

Next, referring to FIG. 4, a description will be made of the operation of the ignition system of this invention in a case where the engine rotational speed is lower than the preset rotational speed of the engine rotational speed detecting circuit 13, as is the case with the start time of the engine. For example, immediately after the start of the engine when a fall in the waveform of the ignition control signal shown at (C) of FIG. 4 has not yet been detected, the $\overline{Q}$0 output signal of the D-type flip-flop 16' having the waveform shown at (D) of FIG. 4 is still in an unstable state, making it difficult to determine whether it is a logic signal "1" or "0", so that a straight use of this Q output signal, as it is, as the cylinder discriminating signal would cause an erroneous operation.

In order to prevent the occurrence of such an erroneous operation, the engine rotational speed detecting circuit 13 detects that the engine rotational speed is low and delivers a logic signal "1". As a result, the gate of the AND circuit 22*b* of the cylinder discriminating signal change over circuit 22 is closed, while, the gate of the AND circuit 22*c* is opened. Thus, the basic cylinder discriminating signal from the cylinder siccrimination sensor 2 is used directly as the cylinder discriminating signal thereby to control the energization of the ignition coil, so that there is no danger of causing an erroenous operation.

In each of the above-described embodiments, there are used, as input signals thereto, the ignition control signal which is produced by the ignition control circuit 4 and the basic cylinder discriminating signal which is produced by the cylinder discrimination sensor 2, and the J-K flip-flop 16 or the D-type flip-flop 16' is used as a means for forming the cylinder discriminating signal by inverting the basic cylinder discriminating signal at the falling transistion point of the ignition control signal. However, the cylinder discriminating signal forming means is not limited to the devices employed in the above-described embodiments, but any other device having an equivalent function may, of course, be employed to obtain similar results.

Furthermore, in each of the above-described embodiments, as a device to be used in the arrangement for assuring a proper operation of the ignition system at the start of the engine, the engine rotational speed detecting circuit 13 is used to detect the engine start condition. However, the device is not limited to such an engine rotational speed detecting circuit, but a starter switch, lubricating oil pressure switch, intake pressure switch or the like, for example, may, of course, be employed to detect the engine start condition, thereby attaining similar results as mentioned above.

Figure 5:
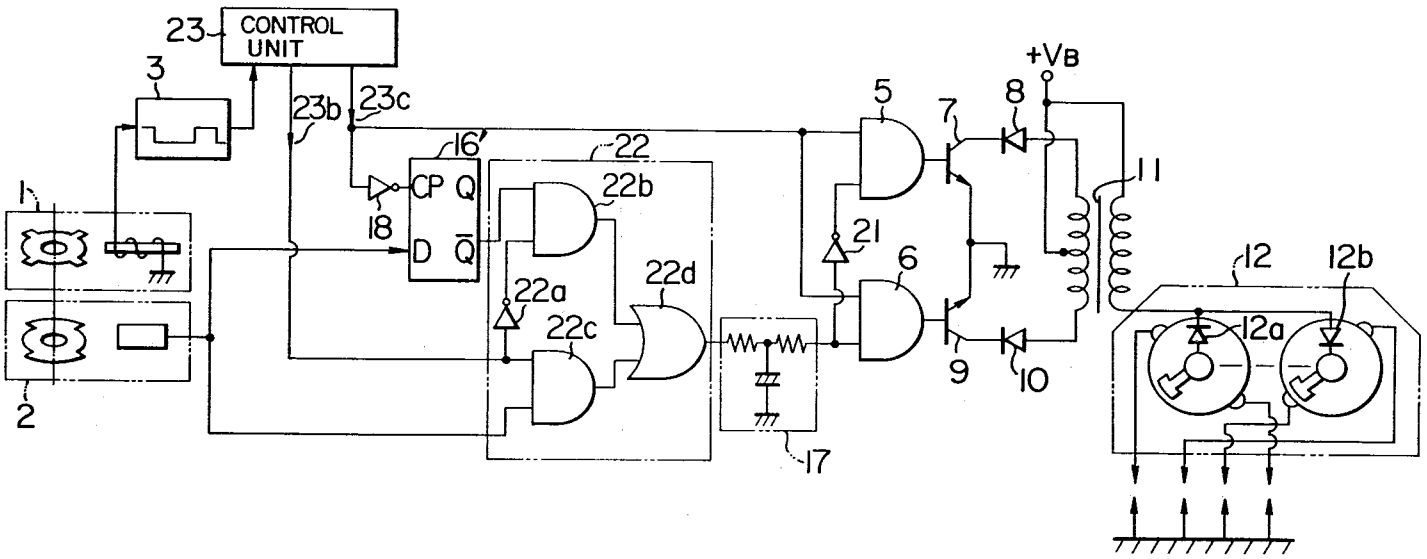
FIG. 5 is an electric circuit diagram illustrating an ignition system of a further embodiment of the present invention.

In addition, the ignition system of this invention may comprise, in place of the ignition control circuit 4 used in the above-described embodiments, a control unit 23 incorporating a microprocessor shown in FIG. 5 which is used to compute and output, for example, an engine rotational speed detection signal 23*b* along with an ignition control signal 23*c*. Such a construction as mentioned above may, of course, attain similar results.

Further, in each of the above-described embodiments, by using the ignition control circuit 4 or the control unit 23 and by inputting the basic ignition signal, both of the ignition time and the energization start time of the ignition coil are electronically controlled. However, it is a matter of course that each of the ignition time and the energization start time may be controlled independently from each other, that the ignition time is firstly controlled on priority basis and the control of the energization start time is effected following the control of the former, and further that only one of the ignition time and the energization start time may be controlled electronically. Each of the abovementioned control types may attain substantially the same results as those obtained by the above-described embodiments of this invention.

Further, with respect to the application of this invention, each of the above-described embodiments showed a case of the application of this invention to an ignition system including a distributor having two high voltage diodes incorporated in the distributor rotor. However, this invention is also applicable to a distributorless ignition system in which a high voltage diode is connected to each output terminal of a secondary coil of an ignition coil and the high voltage generated in the secondary coil is distributed to spark plugs of individual engine cylinders, and this invention is further applicable to another distributorless ignition system, as disclosed in Japanese Patent Application Kokai (Laid-open) No. 55-37536 (1980), which employs double ignition coils the number of which is half that of the cylinders of an internal combustion engine.

I claim:

1. An ignition system for an internal combustion engine comprising:

at least one ignition coil having a plurality of primary coils corresponding respectively to individual cylinders of said internal combustion engine;

basic ignition signal detector means for producing basic ignition signals in synchronism with rotation of said engine;

ignition control means for receiving said basic ignition signals as input signals thereto and producing an ignition control signal having a controlled predetermined pulse width;

basic cylinder discriminating signal detector means for producing a basic cylinder discriminating signal having a period twice that of said basic ignition signals in synchronism with rotation of said engine;

cylinder discriminating signal forming means for receiving said ignition control signal and said basic cylinder discriminating signal as input signals thereto and forming a cylinder discriminating signal comprising said basic cylinder discriminating signal with starting time of pulses thereof shifted to coincide respectively with trailing edges of pulses of said ignition control signal, which trailing edges correspond to ignition time of said engine; and energization signal forming means for generating an energization signal which controls energization of said primary coils of said ignition coil for respective of said engine cylinders in accordance with said cylinder discriminating signal and said ignition control signal.

2. An ignition system for an internal combustion engine according to claim 1, wherein said ignition control means includes means for electronically controlling ignition time of said ignition coil and electronically controlling energization starting time of said ignition coil to thereby ensure a predetermined energization time period during which a primary current flows through at least one of said primary coils of said ignition coil.

3. An ignition system for an internal combustion engine according to claim 1, further comprising:

engine operating condition detecting means for detecting an engine start condition; and cylinder discriminating signal change-over means, responsive to detection by said engine operating condition detecting means that said engine is in said start condition, for supplying to said energization signal forming means said basic cylinder discriminating signal and suspending response by said energization signal forming means to said cylinder discriminating signal so that said basic cylinder discriminating signal is responded to by said energization signal forming means in place of said cylinder discriminating signal during said start condition.

4. An ignition system for an internal combustion engine according to claim 3, wherein said engine operating condition detecting means includes engine rotational speed detecting means for detecting an engine rotational speed and for producing a detection output signal indicating that said engine is in said start condition when detected engine rotational speed is lower than a predetermined value.

5. An ignition system according to claim 3, wherein said cylinder discriminating signal change-over means supplies an output signal thereof to said energization signal forming means to thereby cause the recited change in response of said energization signal forming means during said start condition.

6. An ignition system for an internal combustion engine according to claim 3, wherein said cylinder discriminating signal change-over means includes means for supplying said basic cylinder discriminating signal directly to said energization signal forming means in place of said cylinder discriminating signal during said start condition.

7. An ignition system for an internal combustion engine according to claim 3, wherein said basic cylinder discriminating signal detector means includes a position sensor comprising a Hall effect element.

* * * * *